United States Patent [19]

Kalka

[11] 4,076,204

[45] Feb. 28, 1978

[54] RETAINING CLIP

[75] Inventor: James C. Kalka, St. Paul, Minn.

[73] Assignee: Minnesota Mining and Manufacturing Company, St. Paul, Minn.

[21] Appl. No.: 742,176

[22] Filed: Nov. 16, 1976

[51] Int. Cl.[2] ..... H01R 13/54

[52] U.S. Cl. ..... 248/500; 339/91 R

[58] Field of Search ..... 248/500, 505, 506, 154; 339/91 R, 39

[56] References Cited

U.S. PATENT DOCUMENTS

| | | | |
|---|---|---|---|
| 3,093,773 | 6/1963 | Cole | 339/91 R |
| 3,101,230 | 8/1963 | Bausch et al. | 248/500 |
| 3,197,167 | 7/1965 | Sturgis | 248/500 |
| 3,676,568 | 7/1972 | Fork | 248/500 |
| 3,926,497 | 12/1975 | Eigenbrode | 339/91 R |
| 3,996,500 | 12/1976 | Coules | 248/500 |

FOREIGN PATENT DOCUMENTS

| | | | |
|---|---|---|---|
| 934,889 | 6/1948 | France | 248/500 |

*Primary Examiner*—Marion Parsons, Jr.
*Attorney, Agent, or Firm*—Cruzan Alexander; Donald M. Sell; Edward T. Okubo

[57] ABSTRACT

A hinged retaining clip for retaining two mating pieces together is disclosed. The clip comprises two functional ends joined together along the approximate midpoint of the clip by an integral hinge. One end of the clip is fixedly attached to one of the mating pieces and the other end serves to retain the second mating piece to the first. Positive retention of the two mating parts is effected and maintained by cooperating latching means on the header body and on the clip.

4 Claims, 4 Drawing Figures

RETAINING CLIP

BACKGROUND OF THE INVENTION

The present invention relates to a retaining clip for retaining two mating pieces together and finds particular utility in retaining an electrical header connector to its mating header.

The widespread use of pluggable connectors for electrically interconnecting electronic components has greatly simplified the assembly and/or repair of electronic equipment since assembly of components or replacement of components has merely required the plugging or unplugging of a number of connectors.

However, the very simplicity of the act of plugging and unplugging components to effect electrical interconnection or disconnection has spawned its own unique set of problems — spontaneous disconnection of electrical components by vibration and/or inadvertent unplugging of connectors such as when they are accidentally snagged by a repairman working on an adjacent part. In order to avoid the spontaneous and/or accidental disconnection problems, prior workers have devised headers with locking tabs formed as an integral part thereof. Although these headers with locking tabs have performed quite satisfactorily, they tend to be somewhat larger than the tabless headers thus requiring a little more space than existing headers.

Another problem encountered with the headers with integral locking tabs has been the breaking off of the tabs with the necessity for replacement of the entire header.

SUMMARY OF THE INVENTION

The present invention relates to a hinged retaining clip for retaining two mating pieces together. The clip comprises tow functional ends hinged together along the approximate midpoint of the clip. One end of the clip is fixedly attached to one of the mating pieces and the other end serves to retain the second mating piece to the first. The hinged central portion of the retaining clip allows the second or retaining end of the clip to be swung aside so that the second mating piece can be inserted or removed from the first piece. When the retaining end of the clip is placed into its closed position, positive retention of the mating parts is effected and maintained by cooperating latching means on the header body and on the clip.

BRIEF DESCRIPTION OF THE DRAWINGS

In the accompanying drawing which illustrates the invention.

DETAILED DESCRIPTION OF THE INVENTION

Referring more particularly to the drawings, retaining clip 10 comprises attaching end 15, an integral central hinge 20 and retaining end 25.

Figure 1:
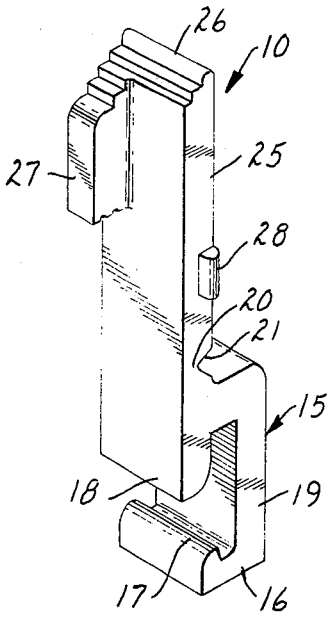
FIG. 1 is a perspective view of the retaining clip of the present invention.
Figure 3:
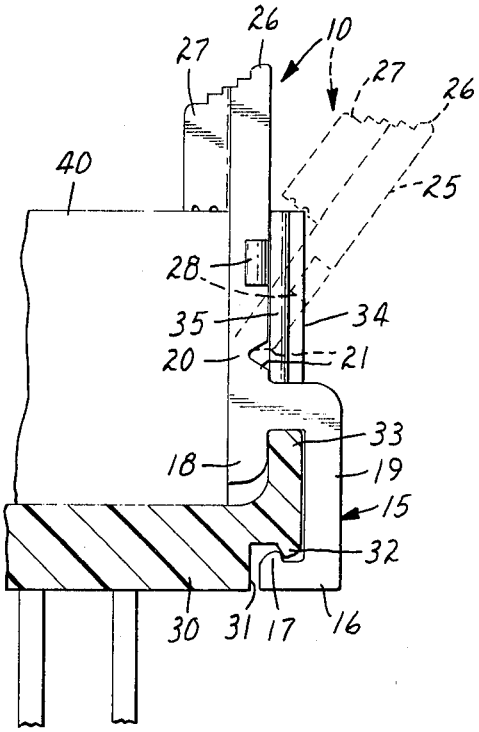
FIG. 3 is an elevational view, partly in section, showing the retaining clip in position on a header.

As can be clearly seen in FIGS. 1 and 3, attaching end 15 is generally C-shaped in cross-section and comprises a first arm 16 which is formed with a hook 17 at its free end, a second arm 18 terminating in a smooth arcuate curve and a central segment 19 connecting the two arms 16, 18 together.

Hinge 20 is formed by molding a groove 21 along the intersection of attaching end 15 and retaining end 25. Examination of the drawings will show that hinge 20 makes it possible to bend retaining end 25 to the right along groove 21, as shown in dotted lines in FIG. 3.

Retaining end 25 is rectangular in plan view and is joined along one end to hinge 20. The other end 26 of retaining end 25 is provided with an anti-slip serrated surface by being stepped toward the left as viewed in FIGS. 1 and 3; the steps are continued to form the top edge of latching member 27, which is affixed on a face adjacent to and along one longitudinal edge of retaining end 25. The bottom edge of latching member 27 is grooved to provide a pair of passive safety catches. In use, latching member 27 retains the connector in the header by resting on the top edge of the connector. Retaining end 25 is also provided with a pair of tabs 28, one along each longitudinal edge.

Header 30 is generally conventional except that the ends thereof have been modified to accept retaining clip 10. The modification at each end consists in providing a recess 31 having a lip 32 into which hook 17 of attaching end 15 can be snap fitted. A shoulder 33 extends upwardly along the central portion of the header base across the end thereof and accommodates arm 18 which is simply hooked thereover. A pair of upstanding header posts 34 is provided on either side of shoulder 33. Each end post 34 has a longitudinal rib 35 along its interior surface. Ribs 35, in cooperation with tabs 28 on retaining clip 10, keep the clip securely latched in the closed position. Of course, ribs 35 and tabs 28 also advantageously serve to keep clip 10 in a fully opened condition. A rectangular keying block 36 is formed integrally with one of said header posts 34 to insure correct orientation of a connector 40 in header 30.

In use, header 30 would be electronically interconnected in the usual manner and secured to a circuit board or some other suitable base (not shown) for interconnection thereto of a connector 40 which has also been suitably electronically interconnected.

Retaining clip 10 is fastened onto header 30 by first hooking arm 18 over shoulder 33 and pivoting attaching end 15 until central segment 19 abuts the outer edge of shoulder 33 and hook 17 or arm 16 snaps into recess 31 past rib 32, at which time retaining clip 10 would be in the position shown in FIG. 3. From this position, retaining clip 10 would be pushed into the dotted line position of FIG. 3. When retaining clip 10 is thus opened, and kept in the opened position by the action of ribs 35 and tabs 28, a connector 40 can be plugged into header 30. This action of plugging or unplugging of a connector 40 into or out of the header 30 is thus accomplished with both hands free. In the connectors of the prior art, it was usually necessary to pry open the locking tabs and to keep one's fingers on the tabs until the connector was plugged into the header. The just described operation frequently literally required three hands — one for each of the locking tabs and the other to handle the connector.

In any event, once the connector is in place, the retaining clip 10 is pushed from the dotted line position shown in FIG. 3 to the closed position, the tabs 28 snapping past the pair of ribs 35 on the header posts 34 with and audible and tactile "click". The bottom edge of latching member 27 would then rest securely on the top edge of connector 40 thus holding it against accidental disconnection either by a workman or through vibration.

Figure 2:
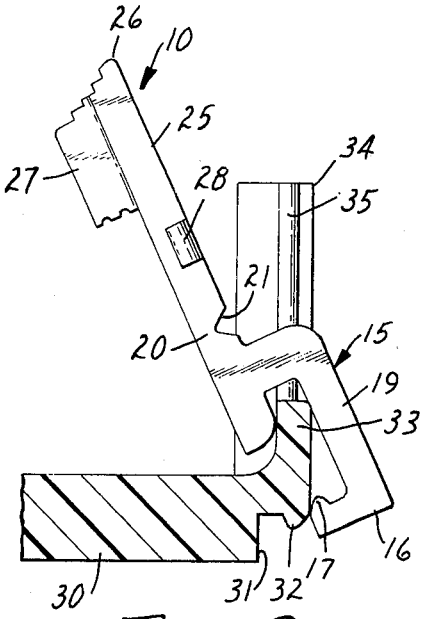
FIG. 2 is an elevational view partly in section, showing the retaining clip of FIG. 1 in the process of being fastened onto a header.
Figure 4:
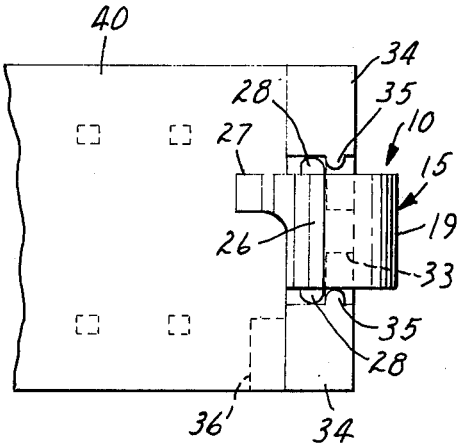
FIG. 4 is a top plan view of the retaining clip and header shown in FIG. 3.

It will be readily apparent to one skilled in the art that a retaining clip for a header and connector is quite small in size since a typical 2 × 13 position header measures approximately 2 inches by ½ inch × ½ inch. The retaining clip which is positioned along a short edge of the header as shown in FIGS. 2, 3 and 4 thus measures approximately 0.68 inch by 0.17 inch by 0.025 inch. Although the retaining clips 10 are small in size, the force required to overcome the retaining clip (pounds of retention) is surprisingly high and depends somewhat on the material from which the clip is fabricated. In a test of representative materials, the following composition values were obtained:

| MATERIAL | POUNDS OF RETENTION | POUNDS OF RETENTION AFTER 25 CYCLES |
|---|---|---|
| Polypropylene | 6 – 7 | 5 – 6 |
| Acetal copolymer (Celcon) | 10 – 11 | 9 – 10 |
| Polytetramethylene terephthalate (PTMT) | 7 – 9 | 6 – 7 |
| Nylon 6,6 | 13 – 14 | 11 – 12.5 |

As the foregoing data clearly shows, nylon is the obviously superior material and is, accordingly, the presently preferred material.

What is claimed is:

1. A retaining clip for retaining two mating pieces together comprising an attaching end of generally C-shaped cross-section having a first arm with a hook formed at its free end, a second arm terminating in a smooth arcuate curve and a central segment connecting said first and second arms together; a rectangular retaining end having a latching member affixed along one edge thereof at its free end, said latching member being adapted for holding one of said mating pieces by resting on a surface thereof, said retaining end also having a latching tab along each longitudinal edge thereof; an integral central hing along the intersection of said attaching end and said retaining end, said hinge permitting oscillating movement of said retaining end of said clip from a first position to a second position.

2. A retaining clip according to claim 1 molded from nylon 6,6.

3. A retaining clip according to claim 1 molded from acetal copolymer.

4. A retaining clip according to claim 1 wherein the mating piece holding surface of said latching member has at least one groove across its width to thereby serve as a passive safety catch.

* * * * *